US008100347B2

(12) United States Patent
Nabeshima

(10) Patent No.: US 8,100,347 B2
(45) Date of Patent: Jan. 24, 2012

(54) PAINT FEEDING DEVICE

(75) Inventor: Atsuo Nabeshima, Okazaki (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 12/664,292

(22) PCT Filed: Jun. 13, 2008

(86) PCT No.: PCT/JP2008/060863

§ 371 (c)(1),
(2), (4) Date: Dec. 11, 2009

(87) PCT Pub. No.: WO2008/153133

PCT Pub. Date: Dec. 18, 2008

(65) Prior Publication Data

US 2010/0193601 A1 Aug. 5, 2010

(30) Foreign Application Priority Data

Jun. 14, 2007 (JP) ..... 2007-157829

(51) Int. Cl.
*B05B 1/28* (2006.01)
*B05B 15/04* (2006.01)

(52) U.S. Cl. ..... 239/105; 239/113; 239/112; 239/108; 118/629

(58) Field of Classification Search ..... 239/108, 239/106, 23, DIG. 13, 8, 9, 10, 68, 104–105, 239/113, 112; 118/56, 632, 690, 629
See application file for complete search history.

(56) References Cited

U.S. PATENT DOCUMENTS

| | | | | | |
|---|---|---|---|---|---|
| 3,179,341 | A * | 4/1965 | Plos et al. | ..... | 239/414 |
| 4,422,576 | A * | 12/1983 | Saito et al. | ..... | 239/693 |
| 4,508,266 | A * | 4/1985 | Saito et al. | ..... | 239/3 |
| 4,830,882 | A * | 5/1989 | Ichinose et al. | ..... | 427/424 |
| 5,293,911 | A * | 3/1994 | Akeel | ..... | 141/346 |
| 6,050,499 | A * | 4/2000 | Takayama et al. | ..... | 239/112 |
| 6,612,345 | B1 * | 9/2003 | Hosoda et al. | ..... | 141/20.5 |
| 7,056,387 | B2 * | 6/2006 | van der Steur | ..... | 118/629 |

FOREIGN PATENT DOCUMENTS

| | | | |
|---|---|---|---|
| JP | 61-167968 | U | 10/1986 |
| JP | 63-86868 | U | 6/1988 |
| JP | 02-75163 | U | 6/1990 |
| JP | 03-86067 | U | 8/1991 |
| JP | 06-134359 | A | 5/1994 |
| JP | 07-13457 | U | 3/1995 |
| JP | 07-323245 | A | 12/1995 |
| JP | 08-131937 | A | 5/1996 |

* cited by examiner

*Primary Examiner* — Dinh Nguyen
*Assistant Examiner* — Chee-Chong Lee
(74) *Attorney, Agent, or Firm* — Kenyon & Kenyon LLP

(57) ABSTRACT

A paint feeding device is equipped with a paint feeding passage, which has a discharge port at one end, to which a rinsing liquid feeding device for feeding a rinsing liquid to the inside, and an air feeding device for feeding air to the inside, are connected to the end portion on the opposite side of the discharge port. A plurality of paint feeding devices for feeding the paint to the inside are connected between the discharge port and the opposite side end portion. The rinsing liquid feeding device and the air feeding device are connected to the paint feeding passage through a rinsing liquid feeding passage disposed separately of the paint feeding passage. The rinsing liquid feeding passage has a passage content volume set according to the feeding capacity of the rinsing liquid per a unit time by the rinsing liquid feeding device.

5 Claims, 9 Drawing Sheets

PAINT FEEDING DEVICE

This is a 371 national phase application of PCT/JP2008/060863 filed 13 Jun. 2008, claiming priority to Japanese Patent Application No. 2007-157829 filed 14 Jun. 2007, the contents of which are incorporated herein by reference.

TECHNICAL FIELD

The present invention relates to a paint feeding device such as a coater and paint filling device, more particularly, to the technique of rinsing a paint feeding passage provided in the paint feeding device.

BACKGROUND ART

The paint feeding device such as the coater, which is used for painting the vehicle body or various casings and the paint filling device, which supplies the paint to the coater, uses various types of paints (e.g. different colors). In such a case, changing valves to change colors, multiple types of paints are fed to the same feeding passage. When changing the colors, rinsing the passage to remove completely the remained paint used just before, then the next paint is fed to the passage.

In the case where the passage is not rinsed sufficiently, the paint includes contaminations (e.g. pollution or mixture) and the paint quality is lowered. Thus, to provide high painting-quality, it is important to rinse the paints remained in the passage and to remove them completely.

In the conventional devices, the long time rinsing may prevent the remaining of the paints. Unfortunately, taking a long time to change the paints lowers the workability, so such a measure actually does not work.

Various techniques of rinsing the paint feeding passage are studied and examined. For example, JP-H6-134359 A discloses the technique that uses the mixer which mixes the rinsing liquid and air to mix the micro air bubbles equally into the liquid, and rinses the passage efficiently.

Alternatively, the technique is carried out that a plurality of first valves for feeding the rinsing liquid and a plurality of second valves for feeding air are connected to the passage, increasing one-time feeding amount, and shorten the rinsing time.

Unfortunately, the conventional techniques need large equipment such as the system equipped with the mixer or the plurality of valves.

Moreover, in the conventional techniques, it is thought that the more discharge amount of the rinsing liquid, the higher rinsing quality is obtained, so that when rinsing the paint feeding passage, the time chart of changing the valves is set for providing the rinsing liquid as much as possible in short time. Therefore, the liquid is wasted and the used amount of the liquid increases uselessly.

DISCLOSURE OF INVENTION

Problems to Be Solved By the Invention

The present invention intends to provide a technique for a paint feeding device enabled by an easy device constitution to obtain the reduction of the quantity of a rinsing liquid and to retain an excellent rinsing property.

Means of Solving the Problems

The first aspect of the present invention is a paint feeding device, which includes an open end; rinsing liquid feeding means for feeding a rinsing liquid into the paint feeding device and air feeding means for feeding an air into the paint feeding device, the rinsing liquid feeding means and the air feeding means disposed at an opposite end to the open end; and a paint feeding passage connected with multiple paint feeding means for feeding the paint into the paint feeding device, the paint feeding passage disposed between the open end and the opposite end; wherein the rinsing liquid feeding means and the air feeding means are connected to the paint feeding passage via a rinsing liquid feeding passage, the rinsing liquid feeding passage configured as a different member from the paint feeding passage, and wherein a volume of the rinsing liquid feeding passage is set in response to a feeding capacity of the rinsing liquid of the rinsing liquid feeding means.

Due to the above structure, the rinsing liquid is fed to the paint feeding passage via the rinsing liquid feeding passage, so that the total volume of the passages is increased and the more rinsing liquid is remained in the passages, which is used for rinsing the paint feeding passage.

Therefore, when the general-purpose valve is adapted as the rinsing liquid feeding means, the rinsing liquid is not overflowed from the paint feeding passage, thereby improving the rinsing property and providing the effective use of the rinsing liquid.

Furthermore, the rinsing liquid feeding passage is constituted as other member than the paint feeding passage, so that the rinsing liquid feeding passage is easily adjusted in response to the feeding capacity of the rinsing liquid of the rinsing liquid feeding means, thereby providing the easy application by reconstructing the existing devices.

In the preferable embodiment of the present invention, the volume of the rinsing liquid feeding passage is set in such a way that a ratio of the feeding amount of the rinsing liquid feeding means with respect to the total volume of the volume of the paint feeding passage and that of the rinsing liquid feeding passage is from 80 to 120%.

Accordingly, the rinsing liquid is used with high efficiency. Thus, the used amount of the rinsing liquid is reduced.

Effect of the Invention

According to the present invention, provided is a technique for the paint feeding device enabled by the easy device constitution to obtain the reduction of the quantity of the rinsing liquid and to retain the excellent rinsing property.

THE BEST MODE FOR CARRYING OUT THE INVENTION

The way of thinking about proper used amount of a rinsing liquid when rinsing a paint feeding passage provided in a paint feeding device.

Figure 5:
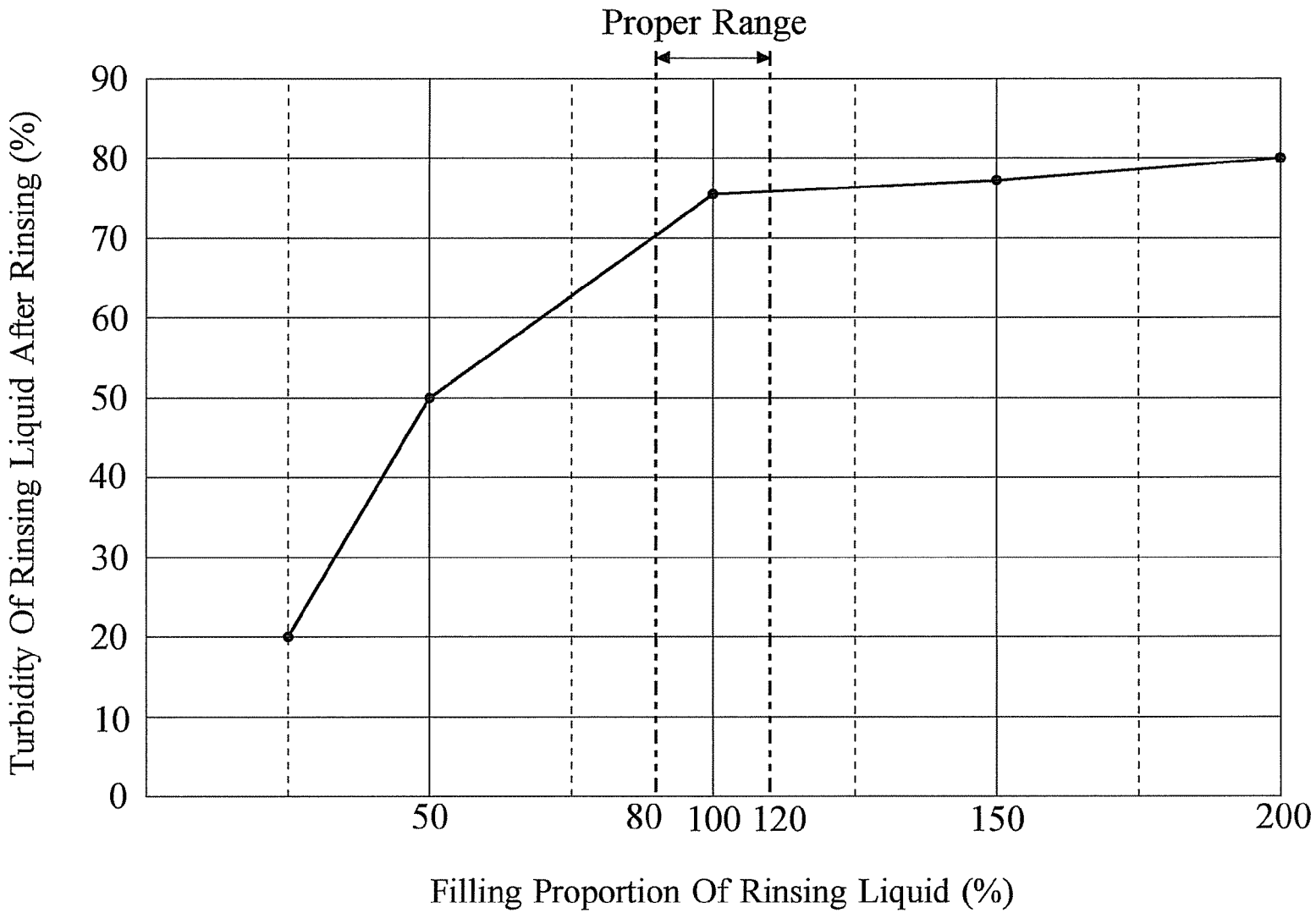
FIG. 5 is a graph showing a relationship between a turbidity of the rinsing liquid after rinsing and a filling proportion of the liquid when rinsing.

FIG. 5 depicts experimental results as a graph showing a relationship between the filling proportion of the liquid into the passage and the rinsing efficiency of the passage. In FIG. 5, the axis of ordinates shows the turbidity after rinsing (%) and that of abscissa shows the filling proportion of the rinsing liquid (%).

In the experiment, preparing multiple samples each of which the inside wall of the passage is adhered by the paint at a certain amount and coordinating the conditions such as rinsing time, the rinsing of each sample is carried out with variation in feeding amount (filling amount) of the rinsing liquid into the passage. The each turbidity of the rinsing liquid after rinsing is detected and considering if detecting the higher turbidity, the more amount of paint is removed from the passage, and the high turbidity means high rinsing efficiency.

In accordance with the results depicted in FIG. 5, the higher the filling amount becomes, the higher the turbidity becomes, however, when the filling proportion becomes over 100% (or when the same amount of the rinsing liquid as the volume of the passage), the turbidity slightly changes if the filling amount is increased, and in such a condition it proves that the increase of the rinsing efficiency becomes small in response to the increase of the used amount of the rinsing liquid. That is to say, in the conventional view, the increase of the used amount of the rinsing liquid improves the rinsing property, however, the above-described experiment proves that the increase does not improve the rinsing property in the case that the filling proportion becomes over 100%.

Additionally, the results indicate that the rinsing liquid remaining in the passage and discharged with the air contributes to the improvement of the rinsing property. In contrast, the liquid overflowed from the passage before the air-feed (the liquid corresponding to the excess portion of the filling amount over 100%) does not contribute to the improvement of the rinsing property.

As mentioned above, in response to the volume of the portion where the rinsing is required, there exists the proper range of the used amount of the rinsing liquid. Setting the used amount of the liquid in the proper range improves the efficiency of rinsing and obtains the reduction of the usage of the liquid.

In the present invention, taking into account that the proper range is not less than 70% of the turbidity after rinsing (%) in FIG. 5, and that the efficient improvement is not obtained when the filling proportion of the rinsing liquid (%) is over 100%, the proper range is set as the range from 80% to 120% in the filling proportion of the liquid (%).

A coater 51 as one embodiment of the conventional paint feeding device is described below.

Figure 7:
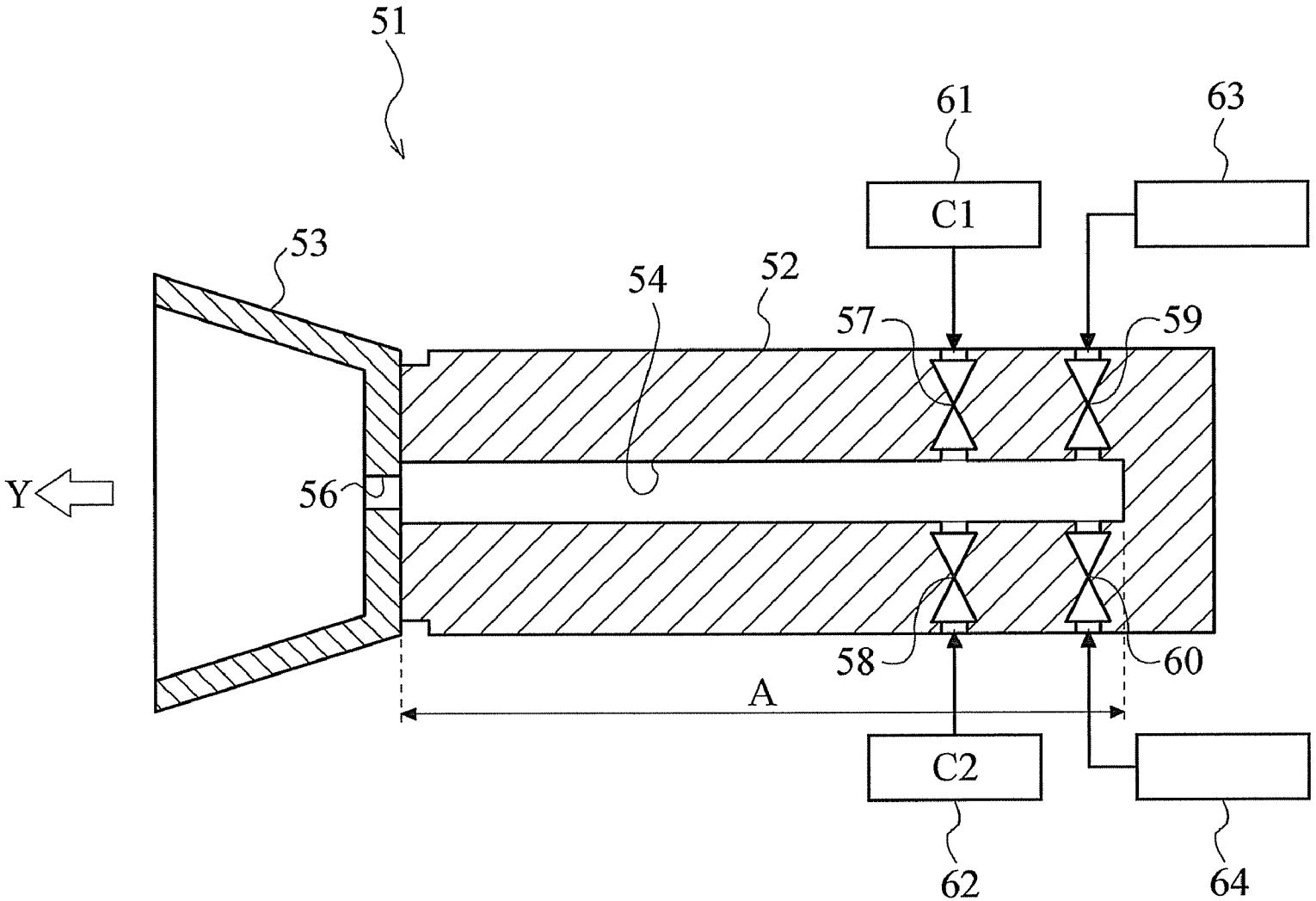
FIG. 7 is a schematic view of a conventional coater.

In the following explanation, the arrow Y in FIG. 7 is taken as the forward for the convenience.

As shown in FIG. 7, the coater 51 contains a main body 52, a bell cup 53, valves for paint (hereinafter called "CCV: Color Change Valve") 57 and 58, a valve for rinsing liquid 59, an air valve 60, paint feeding devices 61, 62, a rinsing liquid feeding device 63, and an air feeding device 64.

The main body 52 has an air motor for rotating the bell cup 53, which is provided in front of the body 52. The bell cup 53 has a cup shape and a bottom face, or the rear face, of which the center is open to define a discharge port 56 from which the paint, rinsing liquid, or air is discharged.

The main body 52 has a paint feeding passage 54 (shown as the area A in FIG. 7). Through the passage 54, the paint, the rinsing liquid, the air and the like can be passed. The front end (open end) of the passage 54 is communicated with the discharge port 56, and the paint, the rinsing liquid or the air is discharged through the port 56. In the painting step, the paint is supplied from the port 56 and flows along the inside face of the cup 53 rotating at high speed, acted by the centrifugal force, and the paint becomes a sprayed paint evenly diffused and is sprayed from the end of the cup 53 to the painting object.

The rear end of the passage 54 is communicated with the valves 59, 60. When the valve 59 is "OPEN," the rinsing liquid is fed from the feeding device 63 to the passage 54. When the valve 60 is "OPEN," the air is fed from the feeding device 64 to the passage 54.

At the nearer portion to the port 56 than the valves 59, 60 (at the downstream side of the passage 54), the CCVs 57, 58 are connected to the passage 54. Due to the arrangement, there does not exist the portion (stagnation point) where the paint is not rinsed in the passage 54. The CCVs are usually prepared in the same numbers as the types of paints to use, but in the embodiment, two types of the paints are used for convenience.

When the CCV 57 is open, paint C1 is fed to the passage 54 from the feeding device 61. When the CCV 58 is open, paint C2 is fed to the passage 54 from the feeding device 62. In this case, when switching the CCVs 57, 58, the passage 54 is rinsed; thus, the mixture of the paints is prevented.

How to rinse the passage 54 of the coater 51 is explained below. In the following explanation, explained the case where the paint C1 is changed to the paint C2.

Figure 4:
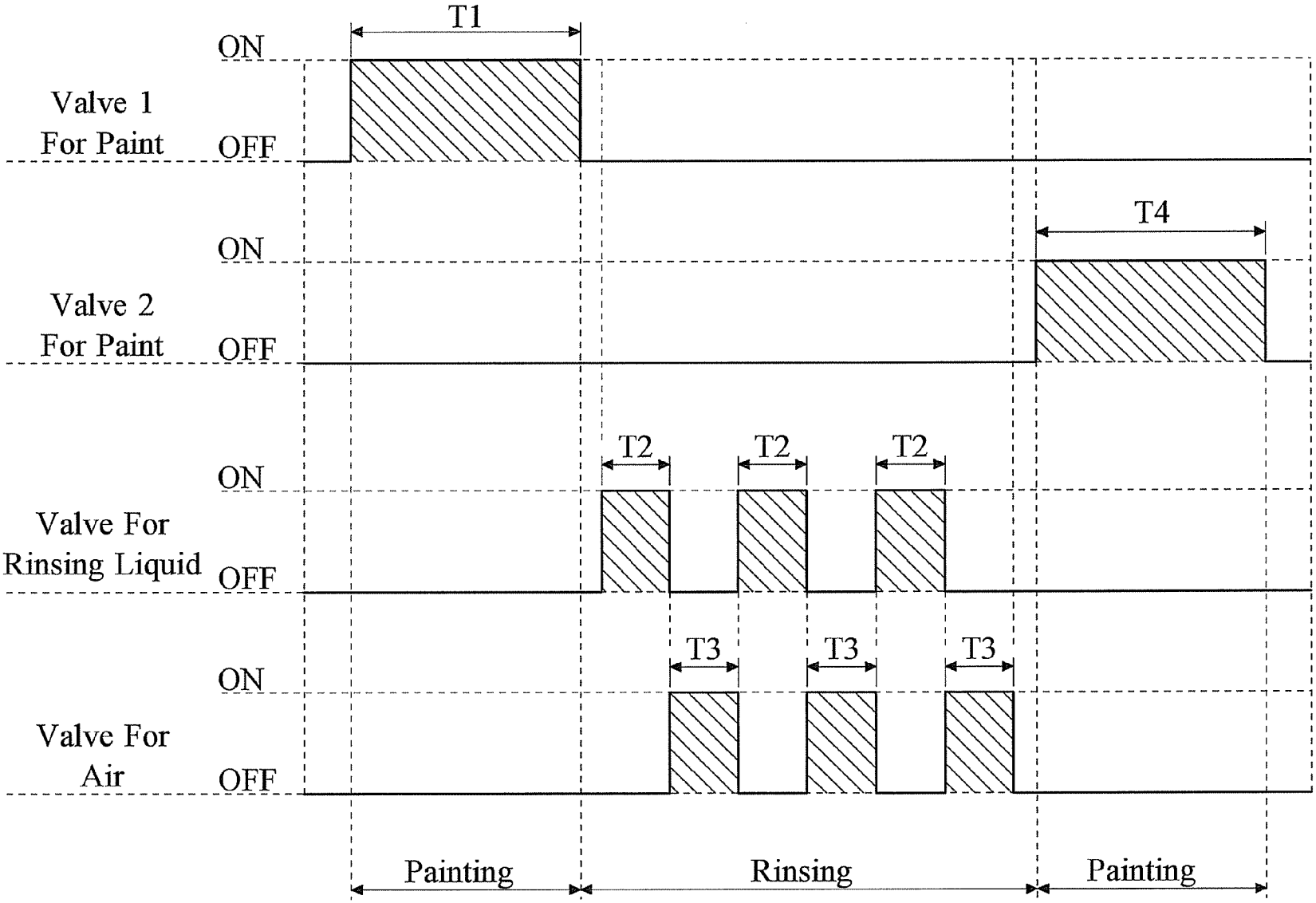
FIG. 4 is a time chart showing operations of valves for rinsing liquid and air.

Each of the valves (valves 57, 58, 59, 60) is controlled by the timing of "OPEN" or "CLOSED" in accordance with the timing chart shown in FIG. 4.

Figure 8:
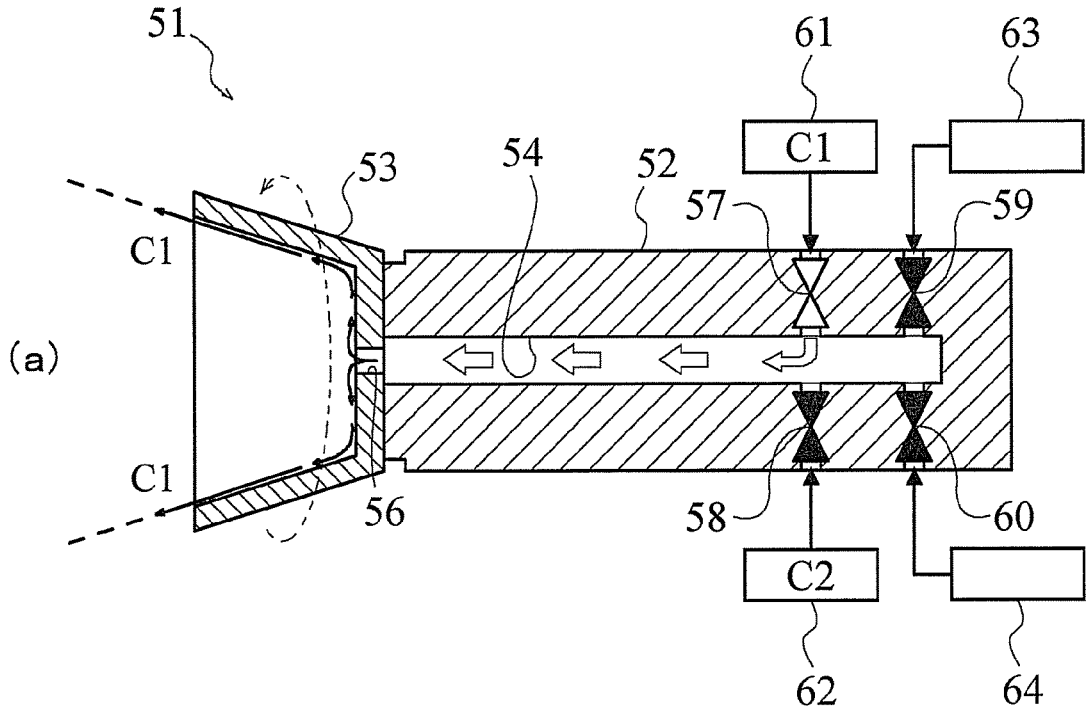
FIG. 8 is a schematic view showing a rinsing step of the conventional coater.
Figure 8:
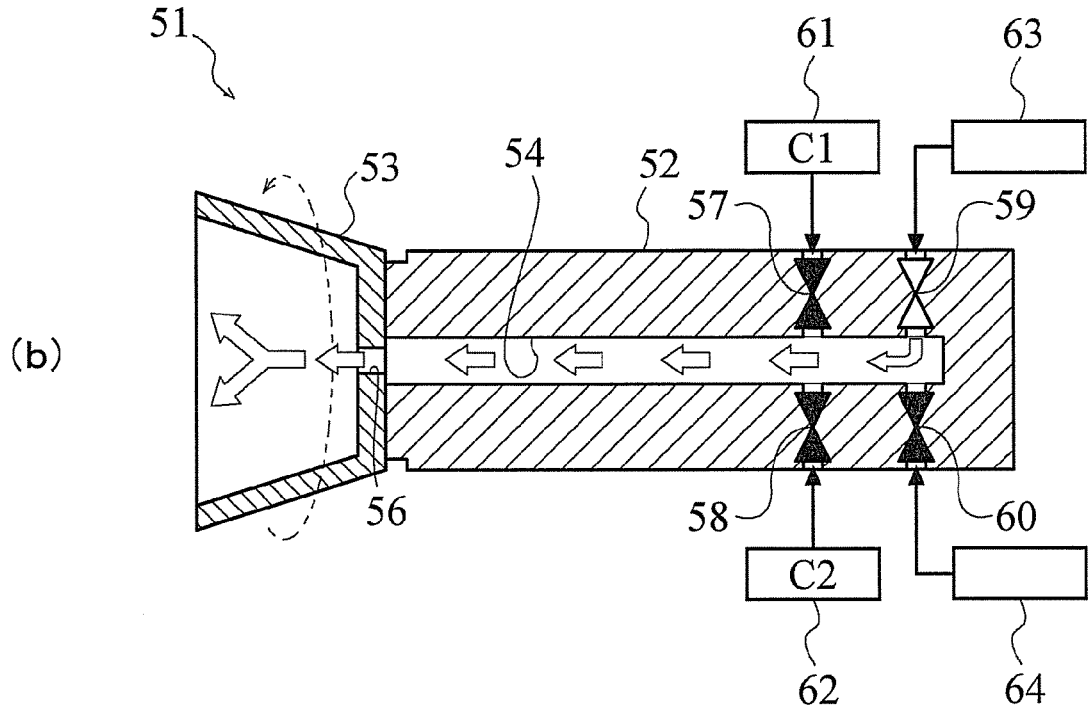

As shown in FIG. 8(*a*), the CCV 57 is open for a certain interval (time T1 in FIG. 4), the paint C1 is fed to the passage 54 from the feeding device 61. The coater 51 sprays the paint C1.

After passing the interval (time T1), the painting step using the paint C1 is finished, and the rinsing step is carried out after a short period.

In the rinsing step, following two steps ((1) feeding the rinsing liquid (2) feeding the air) are repeated for several times.

(1) Feeding the rinsing liquid step: the valve 59 is open for a certain interval (time T2 in FIG. 4), the rinsing liquid is fed to the passage 54 from the feeding device 63.

(2) Feeding the air step: the valve 60 is open for a certain interval (time T3 in FIG. 4), the air is fed to the passage 54 from the feeding device 64.

In the step of (1), the rinsing liquid is fed to the passage 54 by volume (a*T1), when the rinsing liquid feeding capacity of the device 63 is represented by (a).

In the coater 51, when the volume of the passage 54 is represented by (P), an inequity (P<(a*T1)) is satisfied. In other words, it is conventionally known that the more rinsing liquid fed with respect to the volume (P), the more the rinsing property is obtained.

However, in the coater 51, as shown in FIG. 8(*b*), the rinsing liquid that is in excess of the volume (P) is discharged from the port 56 and wasted before the air blow.

As the above explanation using FIG. 5, the wasted liquid does not contribute to the rinsing property; thus, to increase the volume of excess of the liquid leads the waste of the liquid.

The valve with high responsiveness (or the time T1 is set in a short time) is adapted as the valve 59 and the inequity (P>(a*T1)) is satisfied; however, the popular valves are not applied to the valve practically.

Figure 9:
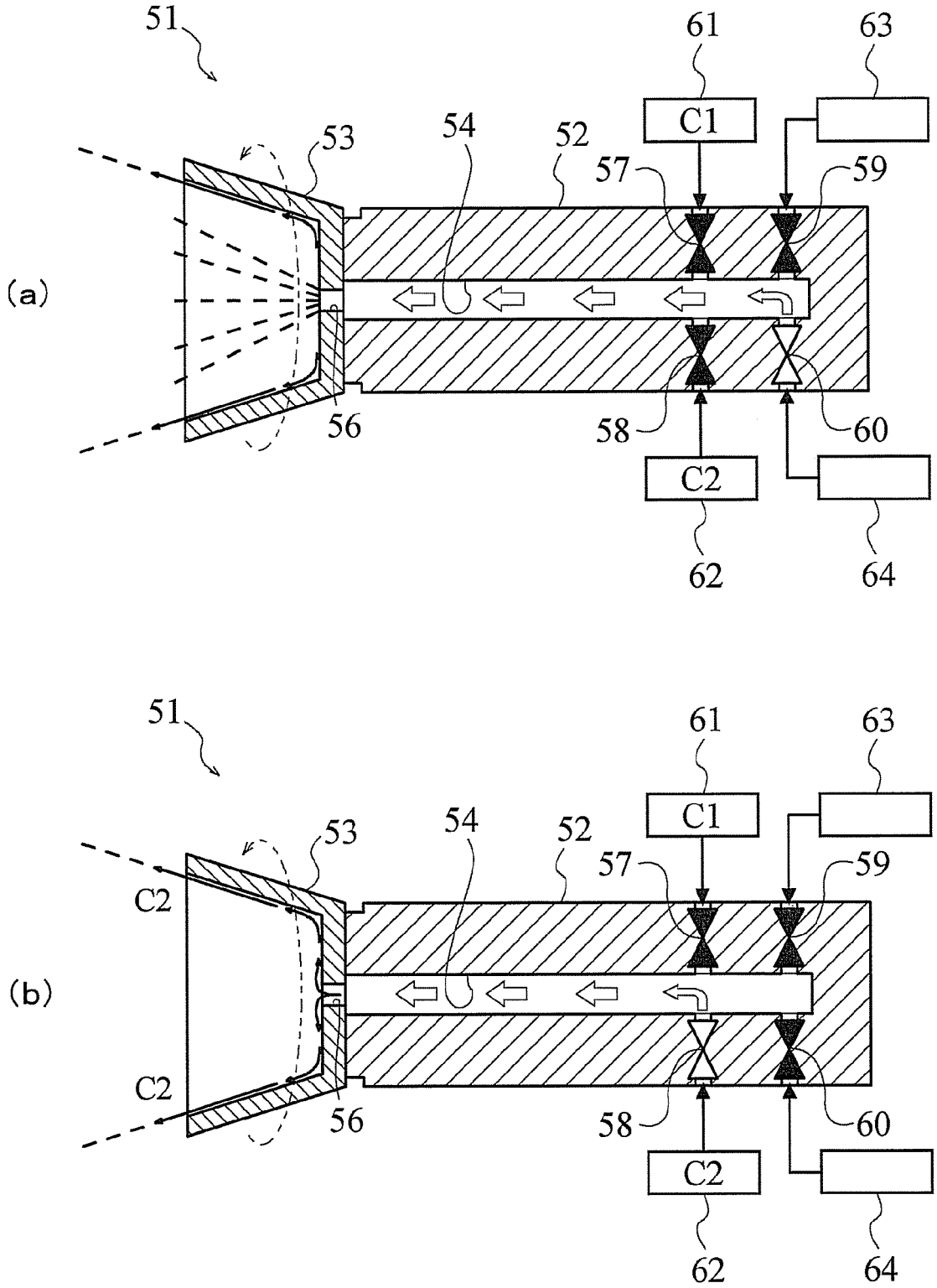
FIG. 9 is a schematic view showing the rinsing step of the conventional coater.

In the step (2), as shown in FIG. 9(*a*), the air fed to the passage 54 blows the rinsing liquid remaining in the passage 54, and the rinsing liquid and air are discharged from the port 56, so that the passage 54 is rinsed.

As shown in FIG. 4, switching the "OPEN" of the valves 59, 60 several times (in this embodiment, three times), the rinsing step is finished. Thus, the feeding and discharging of the rinsing liquid and air are repeated for several times, thereby obtaining the rinsing property. After a short period, the rinsing step is accomplished.

As shown in FIG. 9(*b*), after the rinsing step, the CCV 58 is open for a certain interval (time T4 in FIG. 4), the paint C2 is fed to the passage 54 from the device 62. The coater 51 sprays the paint C2. Thus, the changing colors from the paint C1 to the paint C2 is accomplished.

A coater 1 as one embodiment of the present invention is explained below.

In the following description, the arrow X in FIG. 1 directs the forward for convenience in explanation.

Figure 1:
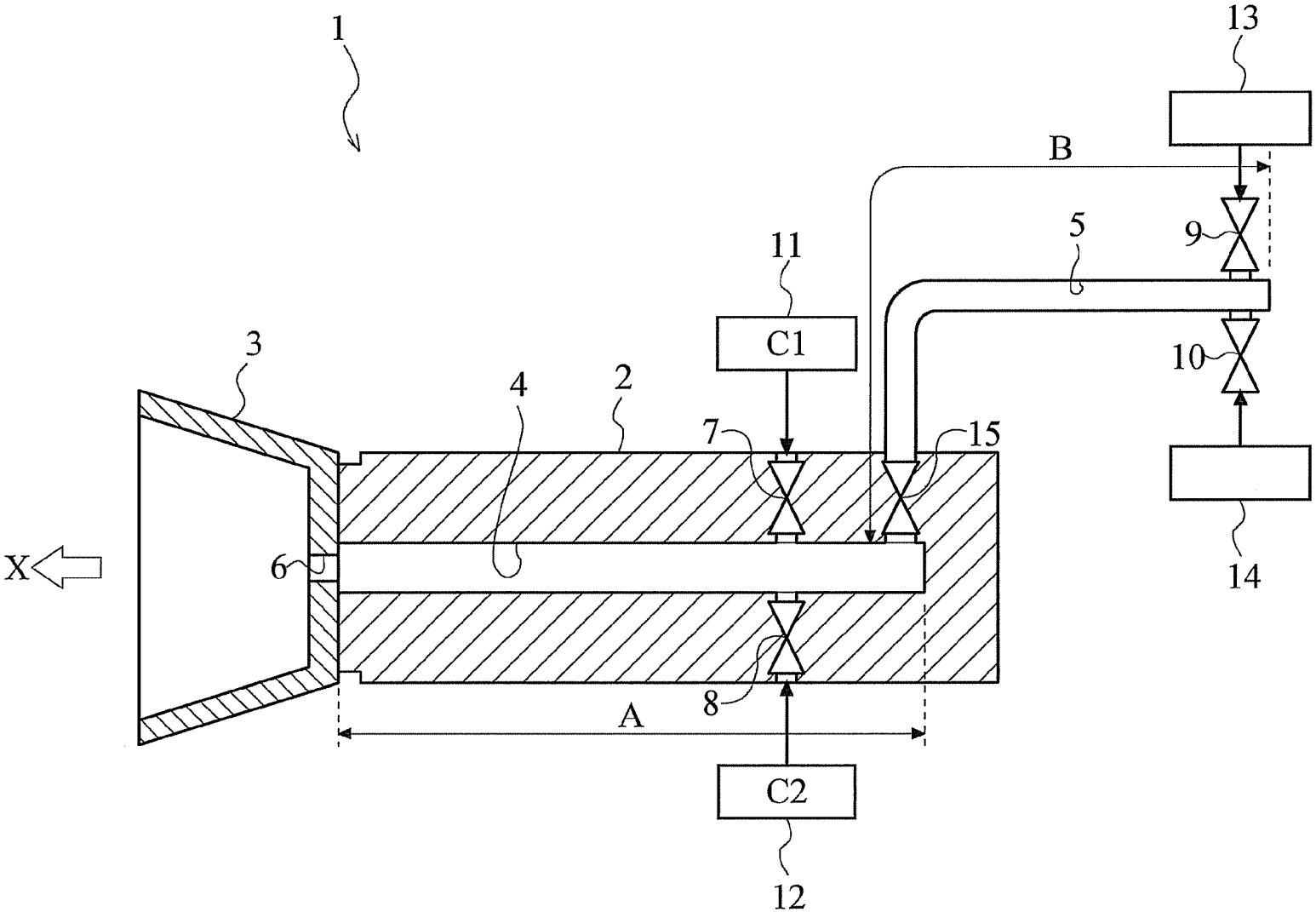
FIG. 1 is a schematic view of a coater according to the present invention.

As shown in FIG. 1, the coater 1 includes a main body 2, a bell cup 3, CCVs 7, 8, a valve for rinsing liquid 9, a valve for air 10, paint feeding devices 11, 12, a rinsing liquid feeding device 13, an air feeding device 14 and a connecting valve 15.

The main body 2 has an air motor for rotating the bell cup 3, which is provided in front of the body 2. The bell cup 3 has a cup shape and a bottom face, or the rear face, of which the center is open to define a discharge port 6 from which the paint, rinsing liquid, or air is discharged.

The main body 2 has a paint feeding passage 4 (shown as the area A in FIG. 1) having a tubular shape. Through the passage 4, the paint, the rinsing liquid, the air and the like can be passed. The front end (open end) of the passage 4 is communicated with the discharge port 6, and the paint, the rinsing liquid or the air is discharged through the port 6.

The coater 1 has the similar structure to the conventional coater 51, and the coater 1 further includes a rinsing liquid feeding passage 5, in which the coater 1 differs from the conventional coater 51.

The rear end of the passage 4 is connected to the tubular passage 5 (shown as the area B in FIG. 1) via the connecting valve 15. The rear end of the passage 5 is connected to the valves 9, 10. In the coater 1, the paint feeding passage 4 is connected with the valves 9, 10 as the different member through the connecting valve 15 and rinsing liquid feeding passage 5.

When the valve 9 is open, the rinsing liquid is fed to the passage 4 from the feeding device 13 via the passage 5. When the valve 10 is open, the air is fed to the passage 4 from the feeding device 14 via the passage 5.

In the embodiment, the connecting valve 15 is always open when using the coater 1. The connecting valve 15 is configured as a gate valve, and when using the coater 1, there occurs the pressure differential in the passage 4 or the pressure differential between the open end of the port 6 and the closed end of the passage 5. Therefore, when feeding the paint C1 or C2, the connecting valve 15 prevents the backflow toward the passage 5.

Moreover, at the nearer portion to the port 6 than the valves 9, 10 (at the downstream side of the passage 4), the CCVs 7, 8 are connected to the passage 4. Due to the arrangement, there does not occur the portion (stagnation point) where the paint is not rinsed in the passage 4. The CCVs are usually prepared in the same numbers as the types of paints to use, but in the embodiment, two types of the paints are used for convenience. Thus, the number of CCVs is not limited to the embodiment.

When the CCV 7 is open, the paint C1 is fed to the passage 4 from the feeding device 11. When the CCV 8 is open, the paint C2 is fed to the passage 4 from the feeding device 12. In this case, when switching the CCVs 7, 8, the passage 4 is rinsed; thus, the mixture of the paints is prevented.

How to rinse the passage 4 of the coater 1 is explained below. In the following explanation, explained the case where the paint C1 is changed to the paint C2.

Each of the valves (valves 7, 8, 9, 10) is controlled by the timing of "OPEN" or "CLOSED" in accordance with the timing chart shown in FIG. 4. Noted that the spending time of the rinsing step is same as the conventional embodiment.

Figure 2:
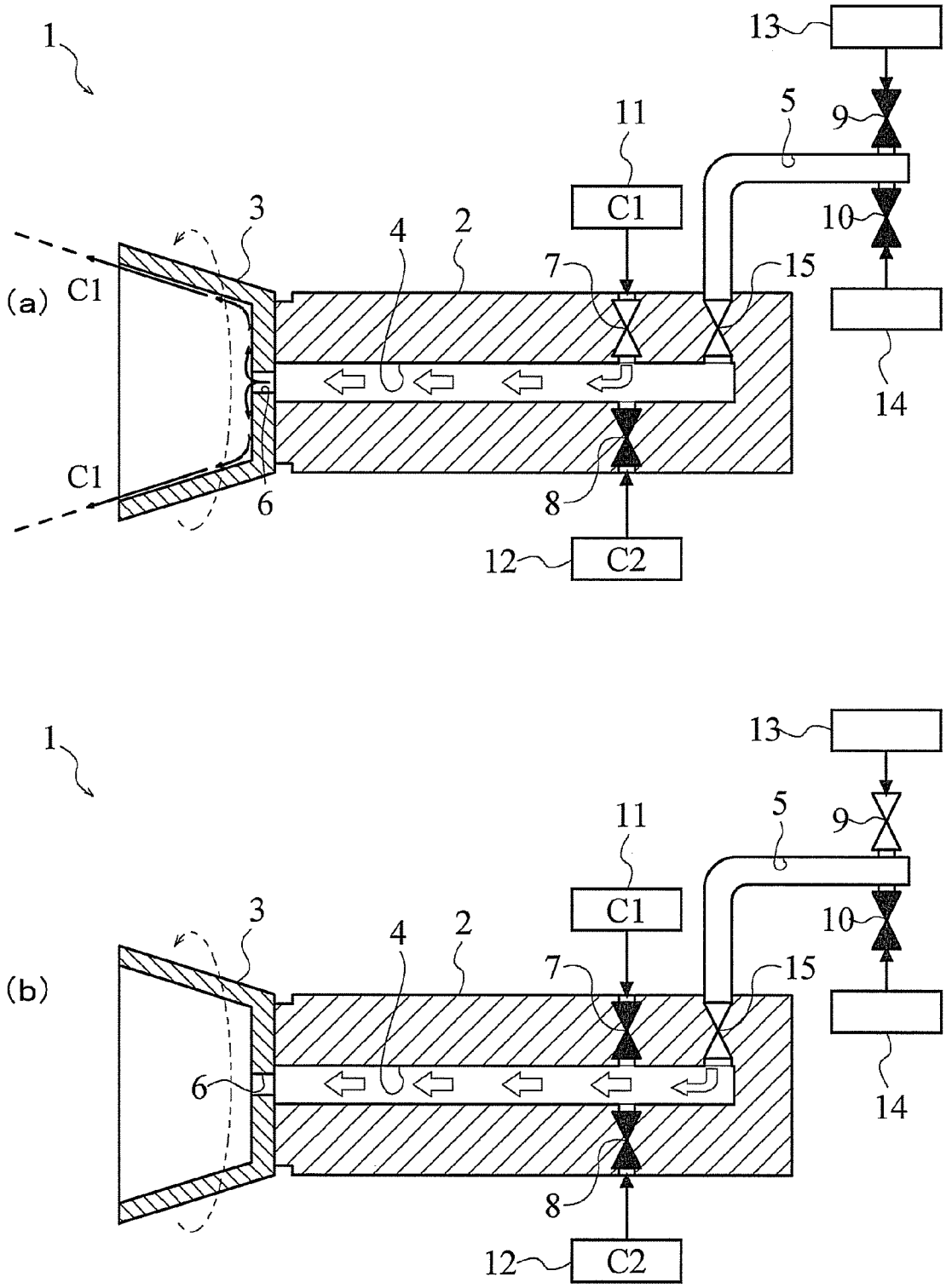
FIG. 2 is a schematic view showing a rinsing step of the coater.

As shown in FIG. 2(*a*), the CCV 7 is open for a certain interval (time T1 in FIG. 4), the paint C1 is fed to the passage 4 from the feeding device 11. The coater 1 sprays the paint C1. After the painting step using the paint C1, the rinsing step is started after a short period as the conventional technique.

After passing the interval (time T1), the painting step using the paint C1 is finished, and the rinsing step is carried out after a short period.

In the rinsing step, following two steps ((1) feeding the rinsing liquid (2) feeding the air) are repeated for several times.

(1) Feeding the rinsing liquid step: the valve 9 is open for a certain interval (time T2 in FIG. 4), the rinsing liquid is fed to the passage 4 from the feeding device 13 via the passage 5.

(2) Feeding the air step: the valve 10 is open for a certain interval (time T3 in FIG. 4), the air is fed to the passage 54 from the feeding device 14 via the passage 5.

In the step of (1), the rinsing liquid is fed to the passage 4 by volume (a*T1), when the rinsing liquid feeding capacity of the device 13 is represented by (a).

In the coater 1, when the volume of the passage 4 is represented by (P) and that of the passage 5 is represented by (Q), the total volume the rinsing liquid passing through becomes (P+Q). If an inequity (P+Q>(a*T1)) is satisfied, the liquid is not overflowed from the port 6. So, in the coater 1, the length or diameter of the passage 5 is set to satisfy the inequity (P+Q>(a*T1)).

As described above, setting the length or diameter of the passage 5 allows, as shown in FIG. 2(*b*), the rinsing liquid fed to the passages 4, 5 to prevent from overflowing from the port 6 and to remain in the passages 4, 5.

As the explanation using FIG. 5, the rinsing liquid remaining in the passages 4, 5 contributes to the improvement of the rinsing property, thereby obtaining the high efficiency of using the rinsing liquid.

In the rinsing step of the passage 4, the passage 5 is configured to satisfy the relationship that the total volume (P+Q), which is obtained by the volume (P) of the passage 4 and the volume (Q) of the passage 5, is larger than the feeding amount (a*T1), which is the feeding amount of the rinsing liquid when opening the valve 9 for a certain interval.

Accordingly, the rinsing liquid is prevented from overflowing from the port 6 without contributing to the rinsing of the passage 4, thereby obtaining the reduction of the usage of the rinsing liquid.

As shown in FIG. 5, the proper range of the filling proportion of the rinsing liquid (%) is set in 80 to 120%, so that the passage 5 is configured in such a way that the ratio of the feeding amount (a*T1) with respect to the total volume (P+Q) of the volume (P) of the passage 4 and the volume (Q) of the passage 5 is from 80 to 120%.

The passage 5 may be adapted as a general-purpose tube, hose or the like, so that considering the diameter thereof and adjusting the length thereof easily brings the setting and adjustment of the volume (Q) of the passage 5.

Furthermore, in the rinsing step of the passage 4, the passage 5 is configured to satisfy the relationship that the feeding amount (a*T1), which is the feeding volume of the rinsing liquid when opening the valve 9 for a certain interval, is 80 to 120% with respect to the total volume (P+Q), which is obtained by the volume (P) of the passage 4 and the volume (Q) of the passage 5.

Above structure allows the effective use of the rinsing liquid, thereby reducing the usage of the rinsing liquid.

Adjusting the volume (Q) of the passage 5 enables to satisfy the inequity (P+Q>(a*T1)) without using the valve with high responsiveness (or the time T1 is set in a short time) for the valve 9 and to use the general-purpose valves, thereby providing the structure easily.

The passage 5 is connected to the passage 4 through the connecting valve 15, which enables to facilitate the changing of the passage 5 to adjust the structure.

Figure 3:
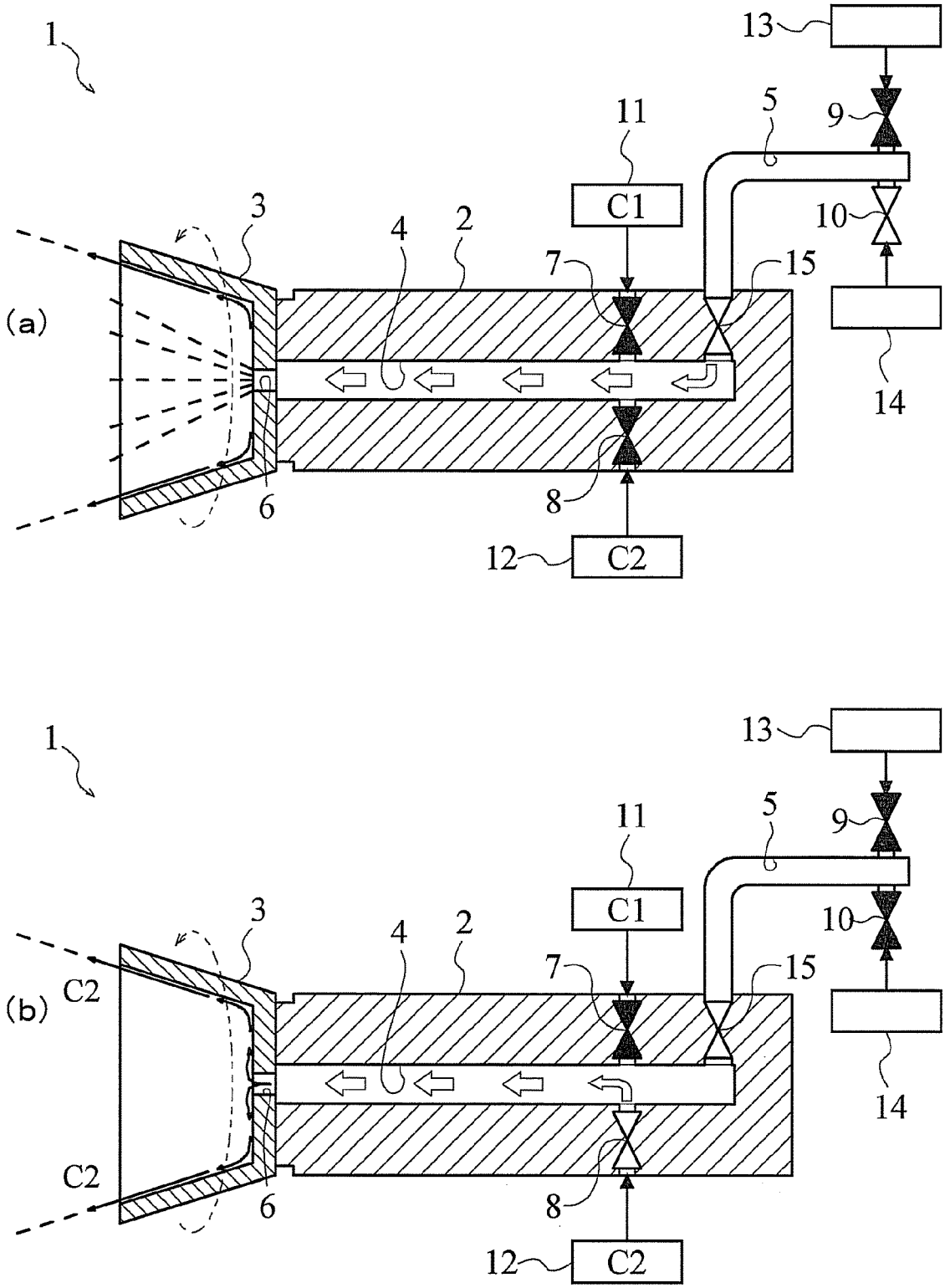
FIG. 3 is a schematic view showing the rinsing step of the coater.

In the step (2), as shown in FIG. 3(*a*), the air fed to the passage 4 blows the rinsing liquid remaining in the passage 4, and the rinsing liquid and air are discharged from the port 6, so that the passage 4 is rinsed.

As shown in FIG. 4, switching the "OPEN" of the valves 9, 10 several times (in this embodiment, three times), the rinsing step is finished. Thus, the feeding and discharging of the rinsing liquid and air are repeated for several times, thereby obtaining the rinsing property. Noted that the number of repeat times may be set as the appropriate number by the time chart, the rinsing step is not limited to the repeat times (three times).

As shown in FIG. 3(*b*), after the rinsing step, the CCV 8 is open for a certain interval (time T4 in FIG. 4), the paint C2 is fed to the passage 4 from the device 12. The coater 1 sprays the paint C2. Thus, the changing colors from the paint C1 to the paint C2 is accomplished.

In the rinsing step of the passage 4, the valves 9, 10 are connected to the one end of the passage 4 via the passage 5, and in accordance with the time chart set in advance the valve 9 is open for a certain interval (time T1) for feeding the rinsing liquid to the passages 4, 5, and the valve 10 is open for a certain interval for feeding the air to the passages 4, 5 and for discharging the rinsing liquid remaining in the passages 4, 5 from the port 6, thereby rinsing the passage 4.

Therefore, more amount of the rinsing liquid used for rinsing the passage 4 can be remained in the passage 4 as the rinsing object, thereby improving the rinsing property.

The present invention may be easily employed for the existing paint feeding devices such as a coater, reconstructing the existing devices and using tubes to connect the rinsing liquid feeding passage, connecting the valve for rinsing liquid and for air, the rinsing liquid feeding passage (the tube) can be adjusted easily in response to the feeding capacity of the rinsing liquid; thus, the rinsing property of the existing coater is improved.

Figure 6:
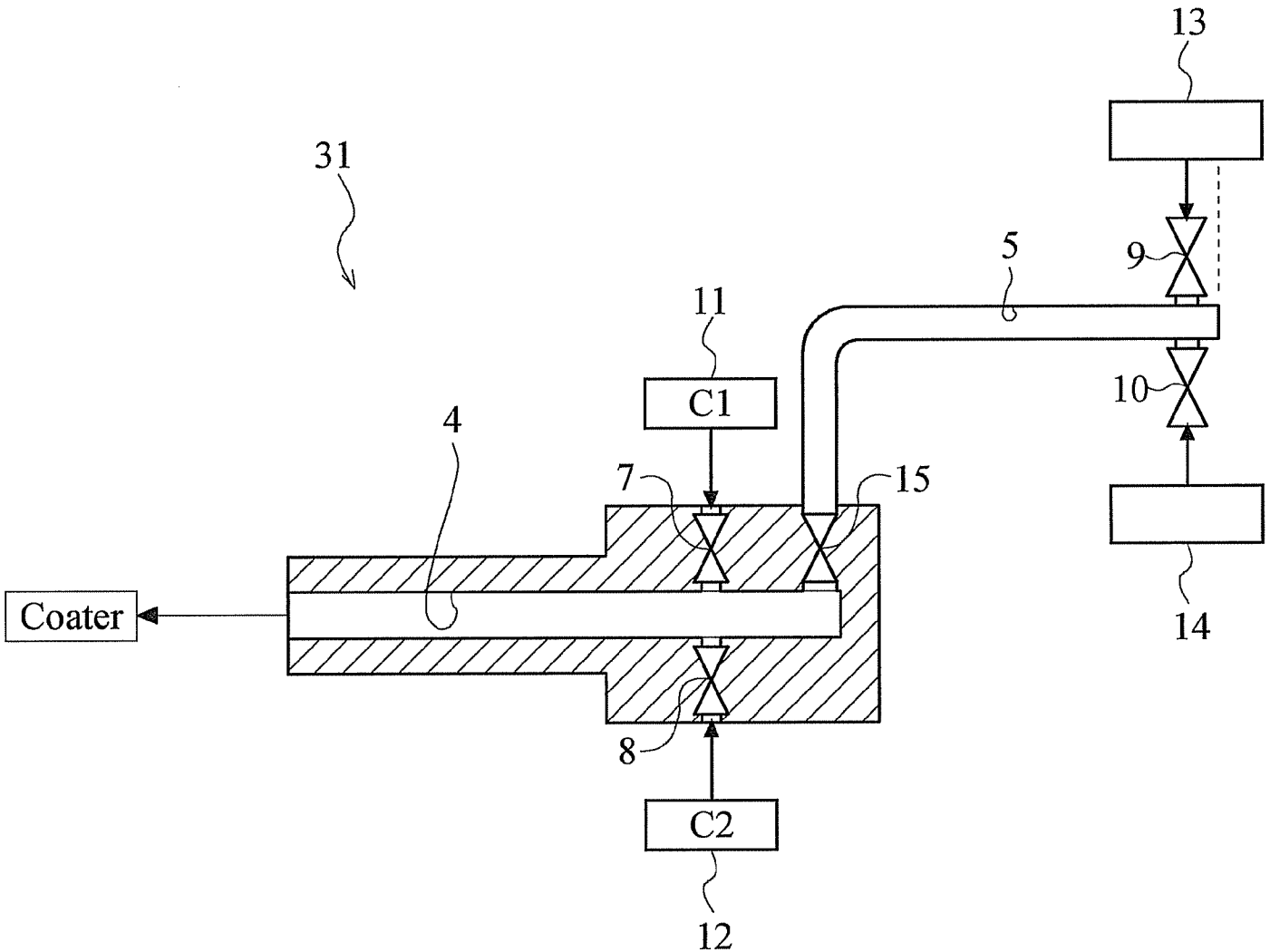
FIG. 6 is a schematic view of a paint filling device according to the present invention.

The paint feeding devices which the present invention may be applicable are not limited to the coater 1, and may be broadly applicable to the devices that perform the rinsing by feeding the rinsing liquid and air to the paint feeding passage, for example, to a paint filling device 31 shown in FIG. 6, in which the main structure thereof is substantially same as the coater 1.

Described in the embodiment, it is not limited to the two systems, that is the paint feeding devices 11, 12 (using only paints C1 and C2), the present invention may be applicable to a coater that has three or more systems; thus, the paint feeding device of the present invention is not limited.

A plurality of the rinsing liquid feeding passages 5 may be connected, and according to the structure, if the proper range of using the rinsing liquid varies in response to the paint property, switching the rinsing liquid feeding passages, each of which has a different volume, allows to retain the proper using amount of the rinsing liquid.

INDUSTRIAL APPLICABILITY

The present invention is applicable to the paint feeding passage provided in the paint feeding devices such as the coater and paint filling device, especially to the technique of rinsing the paint feeding passage with high efficiency.

The invention claimed is:

1. A paint feeding device comprising:

a main body including an open end;

a rinsing liquid feeding portion that feeds a rinsing liquid into the paint feeding device and an air feeding portion that feeds air into the paint feeding device, the rinsing liquid feeding portion and the air feeding portion disposed at an opposite end to the open end, and the rinsing liquid feeding portion and the air feeding portion both being connected to the paint feeding device via a rinsing liquid feeding passage;

a paint feeding passage connected with multiple paint feeding portions that feed the paint into the paint feeding device, the paint feeding passage disposed between the open end and the opposite end, and entirely within the main body; and a valve fluidly connecting the paint feeding passage and the rinsing liquid feeding passage, the valve being disposed within the main body between the paint feeding passage and the rinsing liquid feeding passage;

wherein the rinsing liquid feeding passage is a different member from the paint feeding passage, wherein a volume of the rinsing liquid feeding passage is set in response to a feeding capacity of the rinsing liquid of the rinsing liquid feeding portion, and wherein the paint is fed to the paint feeding passage under the pressure of the paint feeding portions such that the air feeding portion is used only when rinsing the paint feeding passage, and wherein the air fed from the air feeding portion is mixed into the rinsing liquid fed from the rinsing liquid feeding portion in the rinsing liquid feeding passage.

2. The paint feeding device according to claim 1, wherein the volume of the rinsing liquid feeding passage is set in such a way that a ratio of the feeding amount of the rinsing liquid feeding portion with respect to the total volume of the volume of the paint feeding passage and that of the rinsing liquid feeding passage is from 0.8-1.2:1.

3. The paint feeding device according to claim 1, wherein the valve is a gate valve.

4. The paint feeding device according to claim 1, wherein the air is fed into the paint feeding device after the rinsing liquid.

5. The paint feeding device according to claim 1, wherein the multiple paint feeding portions is two paint feeding portions, each paint feeding portion including a valve for independently controlling paint fed therefrom, and wherein when one valve is closed, the other valve may be opened so that paint is fed into the paint feeding passage, and vice versa.

* * * * *